US009449767B2

(12) United States Patent
Haehnel et al.

(10) Patent No.: US 9,449,767 B2
(45) Date of Patent: Sep. 20, 2016

(54) SWITCH CONTACT SUBASSEMBLY HAVING A SWITCH CONTACT BRIDGE AND CONTACT BRIDGE RETENTION MEMBER

(71) Applicant: TE Connectivity Germany GmbH, Bensheim (DE)

(72) Inventors: Thomas Haehnel, Berlin (DE); Udo Gabel, Berlin (DE); Titus Ziegler, Berlin (DE); Wolf-Dieter Heine, Sputendorf (DE); Peter Sandeck, Berlin (DE); Matthias Kroeker, Mittenwalde-Ragow (DE)

(73) Assignee: TE CONNECTIVITY GERMANY GMBH, Bensheim (DE)

( * ) Notice: Subject to any disclaimer, the term of this patent is extended or adjusted under 35 U.S.C. 154(b) by 77 days.

(21) Appl. No.: 14/377,165

(22) PCT Filed: Jan. 30, 2013

(86) PCT No.: PCT/EP2013/051745

§ 371 (c)(1),
(2) Date: Aug. 6, 2014

(87) PCT Pub. No.: WO2013/117468

PCT Pub. Date: Aug. 15, 2013

(65) Prior Publication Data

US 2015/0008105 A1 Jan. 8, 2015

(30) Foreign Application Priority Data

Feb. 9, 2012 (DE) ..... 10 2012 201 966

(51) Int. Cl.
*H01H 1/20* (2006.01)
*H01H 1/30* (2006.01)

(52) U.S. Cl.
CPC ..... *H01H 1/20* (2013.01); *H01H 1/2008* (2013.01); *H01H 1/30* (2013.01)

(58) Field of Classification Search
CPC ..... H01H 1/20; H01H 9/38
USPC ..... 200/243, 249
See application file for complete search history.

(56) References Cited

U.S. PATENT DOCUMENTS 2,303,516 A * 12/1942 Von Mehren ..... H01H 1/20 200/16 A
2,532,305 A 12/1950 Heller
2004/0031668 A1 2/2004 Duchemin et al.

FOREIGN PATENT DOCUMENTS

CN 2874758 (Y) 2/2007
EP 2 290 672 A1 3/2011
EP 2 442 343 A2 4/2012
FR 2895143 * 6/2007 ..... H01H 1/12

OTHER PUBLICATIONS

International Preliminary Report on Patentability issued by the International Bureau of WIPO, Geneva, Switzerland, dated Aug. 12, 2014, for International Application No. PCT/EP2013/051745; 6 pages.

(Continued)

*Primary Examiner* — Edwin A. Leon
*Assistant Examiner* — Iman Malakooti
(74) *Attorney, Agent, or Firm* — Faegre Baker Daniels LLP

(57) ABSTRACT

The invention relates to a switch contact subassembly (1) having a switch contact bridge (2) and a resilient element (3), for example, for an operating current of a switching element which switches an electric or hybrid motor vehicle. In order to be able to produce the switch contact subassembly (1) in a cost-effective and simple manner, there is provision according to the invention for the switch contact subassembly (1) to have a contact bridge retention member (4), the contact bridge retention member (4) having a securing base (14) for securing to an actuation member (15) for the switching element and at least one retention member (17) for positioning the switch contact bridge (2).

13 Claims, 1 Drawing Sheet

(56) References Cited

OTHER PUBLICATIONS

International Search Report and Written Opinion issued by the European Patent Office, dated Apr. 29, 2013, for related International Application No. PCT/EP2013/051745; 7 pages.

Letter Exam Report (English translation) issued by the State Intellectual Property Office of the People's Republic of China, dated Jul. 13, 2016, for related International Application No. 201380008922.0; 10 pages.

* cited by examiner

SWITCH CONTACT SUBASSEMBLY HAVING A SWITCH CONTACT BRIDGE AND CONTACT BRIDGE RETENTION MEMBER

BACKGROUND

The invention relates to a switch contact subassembly having a switch contact bridge and having a resilient element on which the switch contact bridge is resiliently supported counter to a switching direction.

SUMMARY

Switch contact subassemblies, for example, for operating circuit contact breakers of electric or hybrid vehicles having a resilient element which resiliently supports the switch contact bridge of the switch contact subassembly counter to the switching direction and which presses the switch contact bridge against mating contacts in an operating state are generally known. An often rod-like actuation member for the switch contact bridge is constructed in the known switch contact subassemblies as a machine-turned element having grooves for snap rings. One of the spring rings forms a delimitation on which the resilient element is supported. Another snap ring forms a stop for the switch contact bridge, the resilient element pressing the switch contact bridge in the switching direction against the stop. The actuation member extends through an opening in the switch contact bridge so that movements of the switch contact bridge in or counter to the switching direction are guided by the rod-like actuation member.

However, the production of the actuation member as a turned component is costly and the assembly of the known switch contact subassembly with the snap rings is complex.

An object of the invention is therefore to provide a switch contact subassembly which is cost-effective and simple to produce.

This object is achieved for the switch contact subassembly mentioned in the introduction according to the invention by a contact bridge retention member having a securing base for securing to a securing member and having at least one retention member, the resilient element being retained in a pretensioned state between the securing base and the switch contact bridge and the switch contact bridge pressing in a resilient manner against the retention member in a rest position and the retention member and the securing base being constructed integrally with each other.

Since the contact bridge retention member is constructed in order to be secured to the actuation member via the securing base and at the same time to act as a support for the resilient element and as a stop for the switch contact bridge, the switch contact bridge may be assembled in a simple manner without additional components, such as snap rings. Since the snap rings are no longer required, the actuation member can be formed without grooves for receiving the snap rings so that actuation members which are not produced as expensive turned components can also be used.

The solution according to the invention may be further improved by means of different embodiments which may be freely combined with each other and which are each advantageous per se. These embodiments and the advantages connected therewith are set out below, the structural measures and the effects thereof being described purely by way of example.

In order to further simplify the handling of the switch contact subassembly, the switch contact bridge may be clamped in a secure manner in the bridge retention member by means of the resilient element and the switch contact subassembly may thereby be able to be handled in one piece. The switch contact subassembly may therefore be preassembled for connection to the actuation member and may be handled as one piece. Handling of each individual component of the switch contact subassembly for connection to the actuation member, as necessary in the prior art, can be dispensed with.

In order to be able to position switch contacts of the switch contact bridge in a defined manner in the switching direction, the at least one retention member may have at least one and in particular two stops for the switch contact bridge spaced apart from each other in a longitudinal direction of the switch contact bridge. The longitudinal direction of the switch contact bridge may extend transversely relative to the switching direction. The switch contacts of the switch contact bridge may be spaced apart from each other in the longitudinal direction and in particular be arranged at a side of the switch contact bridge directed in the switching direction. If the switch contact bridge abuts the stops only with the side thereof directed in the switching direction, it can be tilted counter to the switching direction and can consequently adapt its position to the position of mating contacts.

The stops may overlap the switch contact bridge in a region between the switch contacts so that known switch contact bridges can be used with the contact bridge retention member. However, in order to be able to ensure sufficient spacing with respect to the switch contacts and in order to prevent collisions with one of the mating contacts, the stops may be constructed as projections which extend transversely relative to the switching direction. In this instance, the stops may extend in or counter to the longitudinal direction and may extend away from each other. Stops which are constructed in this manner may define the position of the switch contact bridge in a stable manner in the rest position thereof since they can act as a stop for regions of the switch contact bridge which are spaced as far away as possible from the centre of the switch contact bridge. However, the switch contact bridge may still be able to be tilted from the rest position thereof counter to the switching direction. Where possible, the stops may at least partially extend as far as a location beside one of the switch contacts, the respective stop being able to be arranged at least partially in a transverse direction orientated transversely relative to the switching direction and the longitudinal direction in front of or behind the switch contact.

In order to enable the switch contact bridge to be inserted into the switch contact subassembly counter to the switching direction, the contact bridge retention member may open in the switching direction. In order to simplify the assembly of the switch contact bridge in the bridge retention member, the at least one retention member may be resiliently redirectable in or counter to the transverse direction. In an advantageous embodiment, the contact bridge retention member is, for example, constructed from spring steel. Should mechanical or thermal requirements on the switch assembly permit, the contact bridge retention member may also be produced from a plastics material.

If the switch contact subassembly has to be replaced, for example, owing to contact erosion, the at least one retention member can be resiliently redirected away from the switch contact bridge so that the switch contact subassembly can be simply removed. Before the assembly of the switch contact bridge, the resilient element can be inserted into the contact bridge retention member and, for example, be retained by means of a catch connection with respect to the securing base.

In order to guide the switching movements of the switch contact bridge in or counter to the switching direction, the at least one retention member may have a guiding portion. The guiding portion may be arranged between the securing base and the stops and may have at least one guiding face for the switch contact bridge that extends parallel with the switching direction. According to an advantageous embodiment, the retention member may be constructed so as to have two guiding faces for the switch contact bridge, which faces are directed away from each other and which extend parallel with the switching direction. A third guiding face may be arranged between the two above-mentioned guiding faces and may be orientated so as to be directed towards the switch contact bridge. In order to prevent friction forces which occur during the guiding of the movements of the switch contact bridge from impairing the switching operations, however, the guiding portion of the at least one retention member may be constructed simply with the two guiding faces which are directed away from each other. The friction forces between the guiding faces and the switch contact bridge are thereby reduced in comparison with three friction faces. Owing to the guiding faces, the switch contact bridge is also guided during switching operations without the actuation member. In comparison with the known switch contact subassemblies being guided by the actuation member, the guiding faces of the retention member guide the switch contact bridge in a more precise manner and even limit rotations of the switch contact bridge about the switching direction.

In order to retain the switch contact bridge in the contact bridge retention member in a secure manner and to be able to guide the movements thereof in an even better manner, the contact bridge retention member may be constructed so as to have two retention members. The two retention members may be opposite each other in a transverse direction of the switch contact bridge and may both rest on the securing base.

In order to prevent undesirable tilting of the switch contact bridge about the longitudinal direction, the two retention members may have at least one stop for the switch contact bridge. In particular one of the two retention members may comprise two stops and the other at least one stop in order to provide a three-point bearing for the switch contact bridge. The stops of one retention member may be arranged with spacing from the stops of the other retention member in the transverse direction in order to ensure stable support for the switch contact bridge. In order to prevent tilting of the switch contact bridge in the rest position, at least three and in particular all the stops may adjoin a common abutment plane counter to the switching direction. If counter-stop regions of the switch contact bridge are also formed in one plane, the switch contact bridge is retained in a stable manner in the rest position thereof.

An ability of the switch contact bridge to tilt about the longitudinal and/or transverse direction in order to adapt to the mating contacts is preferably also ensured by means of stops which are spaced apart from each other in the transverse direction when all the stops are in abutment with the side of the switch contact bridge directed in the switching direction. The counter-stop regions are preferably provided at the side of the switch contact bridge directed in the switching direction.

So that the switch contact subassembly is supported on the stops in a stable manner, the two retention members may define a total of at least three bearing locations for the switch contact bridge, a stop being able to form a bearing location in each case.

In order to simplify the assembly, the contact bridge retention member may be constructed symmetrically relative to a symmetrical plane which extends in the switching direction and the longitudinal direction. Consequently, both retention members may be constructed in substantially the same and in particular an identical manner. With the symmetrical construction of the contact bridge retention member, it may be mounted so as to be rotated through 180° about the switching direction, without the function of the switch contact subassembly being influenced. With a symmetrical contact bridge retention member, however, an even number of stops or bearing locations is provided.

In order to prevent the retention members from protruding into a collision region of one of the mating contacts, the switch contact bridge may have at least one abutment projection which protrudes in a transverse direction and which is in abutment against the retention member or one of the stops in the rest position. In particular, the switch contact bridge may have an abutment projection for each stop, the abutment projections forming counter-stops for the stops.

Side portions of the switch contact bridge directed away from the switch contacts may be constructed as inclined insertion members against which the retention members are in abutment at the beginning of an insertion operation. If the switch contact bridge is now pressed further into the contact bridge retention member counter to the switching direction, the retention members can be resiliently pressed apart or away from each other by the inclined insertion members. The contact bridge retention member is thereby opened so wide that the switch contact bridge can be inserted into the contact bridge retention member without any additional auxiliary means.

The securing base may be constructed so as to have a securing opening which extends in the switching direction. The securing opening is preferably constructed in order to at least partially receive an actuation member and/or to be secured to this actuation member.

In order to be able to fit the securing base to the actuation member, in particular with the switch contact subassembly in the preassembled state, the switch contact bridge may have an assembly through-opening through which the securing opening is accessible counter to the switching direction.

In the preassembled state, in which the switch contact subassembly can be handled in one piece, the securing opening, the assembly opening and the resilient element may delimit an assembly tunnel by means of which the connection between the actuation member and the contact bridge retention member can be produced. To this end, the resilient element may be formed, for example, as a helical spring through which the assembly tunnel extends.

The switch contact subassembly may comprise an actuation member to which the securing base of the contact bridge retention member is secured or can be secured. In order to be able to use the switch contact subassembly in a variable manner, it may be part of a construction kit which comprises various securing members. The securing members of the construction kit are, for example, of different lengths in the switching direction. Furthermore, the construction kit may comprise differently constructed switch contact bridges, contact bridge retention members and/or resilient elements which are adapted to the conditions of the planned use of the switch contact subassembly and which are, for example, correspondingly sized. The switch contact subassembly that has the actuation member can also preferably be preassembled as an assembly which can be handled in one piece.

The actuation member may, for example, be connected or be able to be connected to the contact bridge retention member by means of a screw connection. To this end, however, a thread would have to be provided on the actuation member, whereby production costs of the actuation member are increased. A connection which can be produced in a particularly economical manner is produced by the actuation member being riveted or being able to be riveted to the securing base. In order to produce the rivet connection, a securing end of the actuation member may protrude at least partially through the securing opening of the securing base. The securing end, when the switch contact subassembly is assembled, can be inserted in a simple manner in a switching direction through the securing opening into the assembly tunnel. In order to produce the rivet connection, a riveting tool can be introduced through the assembly opening of the switch contact bridge into the assembly tunnel and can be moved into contact with the securing end. Owing to the action of the riveting tool on the securing end, it may be formed into a rivet head which protrudes into the securing tunnel. In spite of the rivet connection, which cannot be released without being destroyed, between the contact bridge retention member and the actuation member, as explained in the introduction, the switch contact bridge can be simply removed if required and replaced with another switch contact bridge. The resilient element can also be simply removed and another can be used.

Generally, however, the assembly operation is not carried out through the assembly tunnel, but instead only the resilient element or the gap spring is riveted in and then the contact bridge is inserted. The resilient element may further have a very steep characteristic line, the exemplary variations of the spring lengths being able to be relatively large. Fluctuations of the pretensioning force resulting from this may be difficult to overcome. In order to compensate for tolerances, the bridge stops, adapted to the respective tolerance-dependent length of the resilient element, may be stamped and consequently the pretensioning force of the subassemblies can be compensated for.

The actuation member may have a flange at an actuation end, whereby a surface-area of a support shoulder for supporting the securing base can be enlarged. Consequently, the surface-area of the support shoulder can also be significantly increased.

BRIEF DESCRIPTION OF THE DRAWINGS

The invention is explained below by way of example with reference to embodiments and the drawings. The various features of the embodiments may be combined independently of each other, as already set out in the individual advantageous embodiments. In the drawings.

DETAILED DESCRIPTION

The structure and function of a switch contact subassembly according to the invention are first described with reference to the embodiment of FIG. 1.

Figure 1:
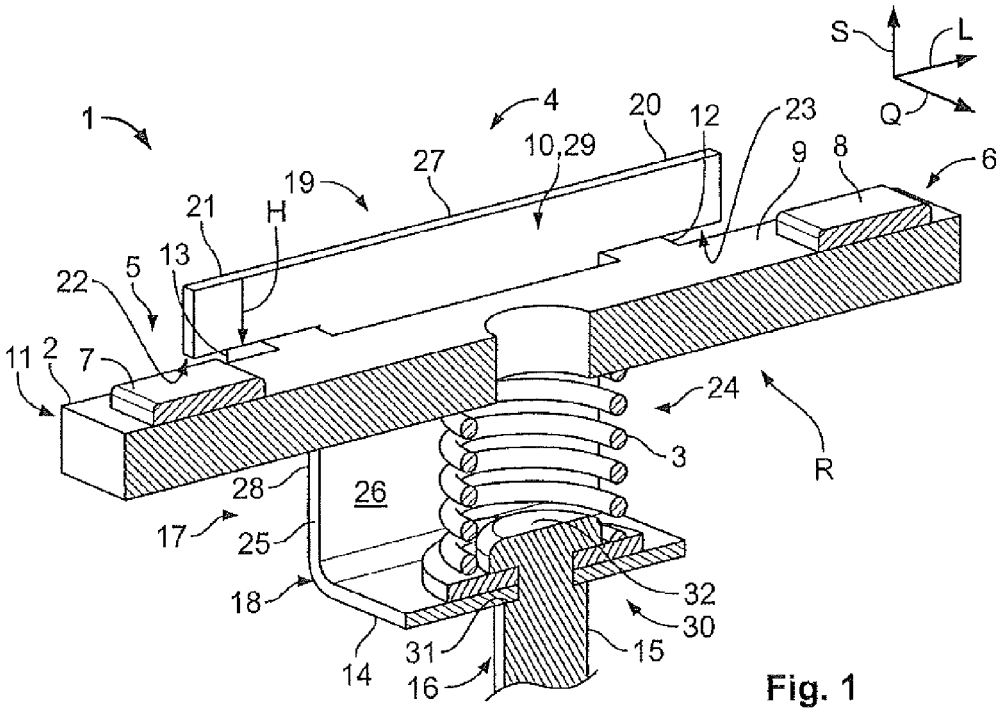
FIG. 1 is a schematic sectioned illustration of an embodiment of the switch contact subassembly according to the invention.

FIG. 1 is a schematic, perspective sectioned view of the switch contact assembly 1, the switch contact assembly 1 being shown in a state sectioned in a longitudinal direction L of a switch contact bridge 2 of the switch contact subassembly 1. The switch contact subassembly 1 may further comprise a resilient element 3 on which the switch contact bridge 2 is resiliently supported counter to a switching direction S, and a contact bridge retention member 4. In the embodiment illustrated, the switch contact subassembly 1 is illustrated in a preassembled state so as to be able to be handled in one piece. In particular, the switch contact bridge 2 may be securely clamped in the contact bridge retention member 4 by the resilient element 3.

The switch contact bridge 2 may extend in the longitudinal direction L thereof and be constructed with switch contacts 7, 8 in end or contact regions 5, 6 which are located in or counter to the longitudinal direction L. In order to be able to bridge mating contacts, the switch contacts 7, 8 may be arranged at a side 9 of the switch contact bridge 2 which is directed in a switching direction S and which can also be referred to as a switch contact side. The switch contact bridge 2 may be constructed in a substantially bar-like or rod-like manner and may have a substantially rectangular cross-sectional surface-area. The cross-section may extend in the switching direction S and in a transverse direction Q which extends transversely relative to the switching direction S and the longitudinal direction L. Between the contact regions 5, 6, the switch contact bridge 2 may be constructed so as to have an assembly opening 10. The assembly opening 10 may extend completely through the switch contact bridge 2 in the switching direction S and in particular be formed in the longitudinal direction L and/or in the transverse direction Q centrally through the switch contact bridge 2.

From a first lateral side 11 of the switch contact bridge 2 which is directed counter to the transverse direction Q and which extends in the longitudinal direction L, at least one abutment projection 12 may protrude. The abutment projection 12 preferably extends from the first lateral side 11 counter to the transverse direction Q and terminates flush with the switch contact side 9 in the switching direction S. The switch contact bridge 2 may comprise another abutment projection 13 which is arranged in the longitudinal direction L with spacing from the abutment projection 12 at the first lateral side 11. The abutment projections 12, 13 may be arranged with the same spacing with respect to specific elements of the switch contact bridge 2, for example, with respect to the contact regions 5, 6. Preferably, the abutment projections 12, 13 are arranged symmetrically with respect to the assembly opening 10, that is to say, with the same spacing from the assembly opening 10 in opposing directions, respectively.

In particular, the switch contact bridge 2 may be constructed symmetrically with respect to a plane which extends centrally through the assembly opening 10 in the switching direction S and the transverse direction Q.

The contact bridge retention member 4 may be formed with a securing base 14 which extends substantially transversely relative to the switching direction S and parallel with a plane which is defined by the longitudinal direction L and the transverse direction Q. The securing base 14 may be adapted in order to be or to become connected to an actuation member 15 so as to transmit movement. To this end, the actuation base 14 may, for example, have a securing opening 16 which extends through the securing base 14 in the switching direction S.

The contact bridge retention member 4 may further have at least one retention member 17 which rests on the securing base 14 or rises from the securing base 14 and extends from the securing base 14 in the switching direction S. The retention member 17 and the securing base 14 may be constructed, for example, from metal and in particular as a single-piece punched/bent shaped component. The retention member 17 may thus merge in a bent shoulder region 18 of the switch contact bridge 2 into the securing base 14.

A free end 19 of the retention member 17 directed away from the securing base 14 in the switching direction S may be able to be resiliently redirected with respect to the securing base 14 in or counter to the transverse direction Q. In the region of the free end 19, the retention member 17 preferably has a stop projection 20 for the switch contact bridge 2, which projection protrudes in the longitudinal direction L. In order to be able to retain the switch contact bridge 2 in a defined position, the retention member 17 preferably has at least one additional stop projection 21, the stop projections 20, 21 being able to protrude in a direction away from each other.

The stop projections 20, 21 may be arranged in the switching direction S behind the abutment projections 12, 13 of the switch contact bridge 2. In the illustrated rest position R of the switch contact bridge 2, the resilient element 3 presses the switch contact bridge 2 in the switching direction S so that the abutment projections 12, 13 abut the stop projections 20, 21. The switch contact bridge 2 is thereby orientated in a defined manner in the rest position R thereof. In particular, tilting about the transverse direction Q can thus be prevented. The stop projections 20, 21 therefore form stops 22, 23 for the switch contact bridge 2 which are directed counter to the switching direction S and against which the abutment projections 12, 13 are in abutment in the rest position R owing to the resilient force of the resilient element 3.

In a switching state in which the switch contact bridge 2 abuts mating contacts, the switch contact bridge 2 may be displaced counter to the switching direction S in the direction towards the securing base 14. In order to prevent undesirable tilting about the transverse direction Q, the retention member 17 may have lateral guiding faces 24, 25. One of the abutment projections 12, 13 may be in abutment with each of the lateral guiding faces 24, 25, and may be guided in or counter to the switching direction S during movements of the switch contact bridge 2. In order to enable adaptation to any positional tolerances of the mating contacts, the abutment projections 12, 13 may be arranged so as to be spaced apart from the adjacent lateral guiding face 24, 25 in each case. A tilting play which is thereby produced about the transverse direction Q is then limited by the lateral guiding faces 24, 25. In addition, a face 26 which is directed in a transverse direction Q or which is directed towards the switch contact bridge 2 may also be constructed as a guiding face.

In a front view of the retention member 17 in the transverse direction Q, therefore, the member 17 has according to the embodiment shown a T-shaped front, a transverse portion of the T-shaped retention member 17 that extends in the longitudinal direction L being able to be referred to as a retention or stop portion 27 and a portion of the retention member 17 that extends in the switching direction S from the securing base 14 in the direction towards the stop portion 27 being able to be referred to as a guiding portion 28.

The resilient element 3 is arranged in a pretensioned state in the rest position R between the switch contact bridge 2 and the securing base 14 and may be secured in a non-positive-locking manner against undesirable displacement in the longitudinal direction L or in the transverse direction Q. Alternatively, the resilient element 3 can be connected in a positive-locking manner or in a non-positive-locking manner to and, for example, be engaged with the contact bridge retention member 4 or the securing base 14 thereof and/or the switch contact bridge 2. The resilient element 3 may be supported in each case via a washer on the switch contact bridge 2 and/or the securing base 14.

The resilient element 3 may be constructed as a helical spring whose centre axis extends parallel with the switching direction S and which may be arranged concentrically with respect to the assembly opening 10 and the securing opening 16. The assembly opening 10, the resilient element 3 and the securing opening 16 may consequently form an assembly tunnel 29 in which an assembly tool can be inserted counter to the switching direction S.

Owing to the resilient element 3, the switch contact bridge 2 may be securely clamped in the contact bridge retention member 4 and the switch contact subassembly 1 may thereby be able to be handled in one piece. That preassembled switch contact subassembly 1 can be readily connected to the actuation member 15. For example, the actuation member 15 may be formed as an actuation rod and may comprise a securing end 30 which is directed in the switching direction S. The securing end 30 may, for example, be constructed in order to be connected to the contact bridge retention member 4 by means of a screw connection. Preferably, however, the securing end 30 is provided for a rivet connection to the securing base 14. In a non-assembled state of the actuation member 15, such a securing end 30 is constructed as a rivet projection which extends in the same manner as the remaining actuation member 15 in the switching direction S, but which may have a smaller diameter in the transverse direction Q and/or in the longitudinal direction L than the remainder of the actuation member 15.

The securing end 30 may be arranged on a support shoulder 31 on which the securing base 14 can be supported in order to assemble the actuation member 15. If the securing base 14 is arranged on the support shoulder 31, the securing end 30 protrudes into the assembly tunnel 29. If a riveting tool is now introduced into the assembly tunnel 29 counter to the switching direction S through the assembly opening 10, the securing end 30 can thereby be shaped to form a rivet head 32 and the securing member 15 can be secured to the contact bridge retention member 4 by means of the rivet connection produced. Therefore, the securing base 14 is preferably retained in a riveted, that is to say, clamped, state between the support portion 31 and the rivet head 32 which are both portions of the actuation member 15.

Figure 2:
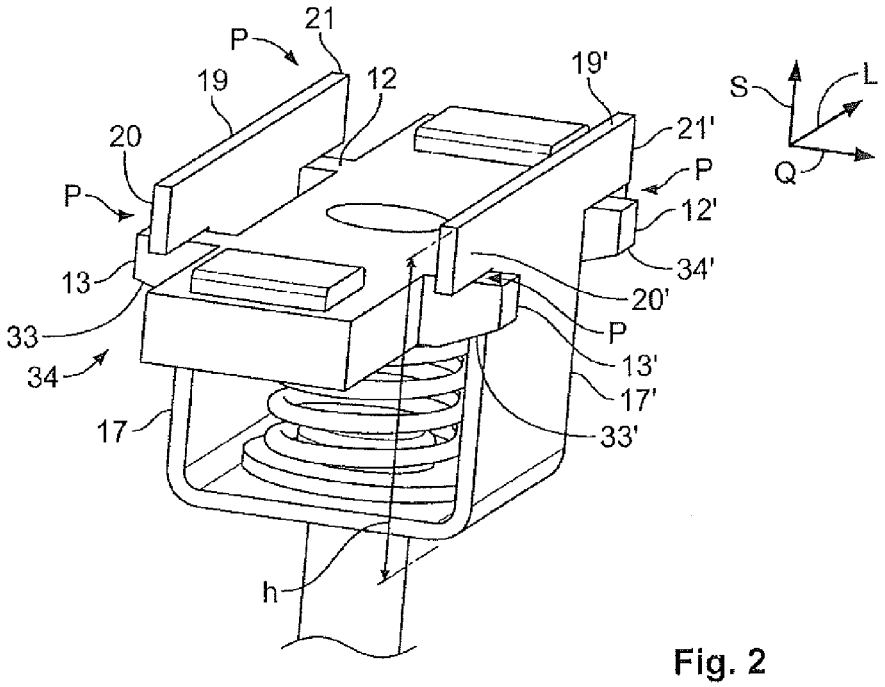
FIG. 2 is a schematic, perspective illustration of the switch contact subassembly of the embodiment of FIG. 1.

FIG. 2 is a schematic, perspective view of the switch contact subassembly 1 of FIG. 1.

As can be seen from FIG. 2, the switch contact subassembly 1 may have in addition to the retention member 17 another retention member 17'. The two retention members 17, 17' may be formed together with the securing base 14 as a punched/bent shaped component. Both retention members 17, 17' can preferably be resiliently deformed so that the free ends 19, 19' thereof can be redirected in and counter to the transverse direction Q, respectively. This resilient deformation of the retention members 17, 17' facilitates insertion of the switch contact bridge 2 into the contact bridge retention member 4 that is open in the switching direction S. The free ends 19, 19' can thus be bent away from each other manually or using a tool in order to insert a switch contact bridge 2 which is provided with abutment projections 12, 13 into the contact bridge retention member 4 counter to the switching direction S.

Both the contact bridge retention member 4 and the switch contact bridge 2 may be constructed symmetrically relative to a plane which extends in the switching direction S and the longitudinal direction L. Consequently, the switch contact bridge 2, in addition to the abutment projections 12, 13, may have other abutment projections 12', 13'. The abutment projections 12, 12' or 13, 13' which are arranged one behind the other in the transverse direction Q may be arranged in alignment with each other and in particular spaced apart from each other in the transverse direction Q. Undesirable tilting of the switch contact bridge 2 about the longitudinal direction L can thereby be prevented. In the embodiment of FIG. 2, the stop projections 20, 21, 20', 21' form four bearing locations P for the switch contact bridge 2 or for the abutment projections 12, 13, 12', 13' thereof. For stable support of the switch contact bridge 2, however, three bearing locations may also be sufficient. If it is sufficient, two bearing locations or even only one bearing location may also be provided. Alternatively, however, more than four bearing locations may also be provided.

Sides of the abutment projections 12, 12', 13, 13' directed away from the switch contacts 7, 8 may be constructed as inclined insertion members 33, 33', 34, 34' with which the free ends 19, 19' of the retention member 17, 17' are in abutment at the beginning of an insertion operation. If the switch contact bridge 2 is now pressed further into the contact bridge retention member 4 counter to the switching direction S, the free ends 19, 19' can be resiliently pressed away from each other by the inclined insertion members 33, 33', 34, 34'. The contact bridge retention member 4 is thereby opened to such an extent that the switch contact bridge 2 can be inserted past the stop projections 20, 20', 21, 21' into the contact bridge retention member 4.

LIST OF REFERENCE NUMERALS

1 Switch contact assembly
2 Switch contact bridge
3 Resilient element
4 Contact bridge retention member
5, 6 Contact bridge of 2
7, 8 Switch contacts
9 Switch contact side of 2
10 Assembly opening in 2
11 Lateral side of 2
12, 13 Abutment projection
14 Securing base of 4
15 Actuation member
16 Securing opening of 14
17 Retention member of 4
18 Shoulder region of 4
19 Free end of 17
20, 21 Stop projection of 17
22, 23 Stops for 2
24, 25, 16 Guiding faces
27 Stop portion
28 Guiding portion
29 Assembly tunnel
30 Securing end of 15
31 Support shoulder of 30
32 Rivet head
33, 34 Inclined insertion members of 12, 13
L Longitudinal direction of 2
S Switching direction
Q Transverse direction
R Rest position of 2
P Bearing locations

The invention claimed is:

1. A switch contact subassembly, comprising:

a switch contact bridge having a resilient element on which the switch contact bridge is resiliently supported counter to a switching direction, a contact bridge retention member having a securing base for securing to an actuation member and having at least one retention member, the resilient element being retained in a pre-tensioned state between the securing base and the switch contact bridge and the switch contact bridge pressing in a resilient manner against the retention member in a rest position (R) and the retention member and the securing base being constructed integrally with each other;

wherein the contact bridge retention member is constructed so as to have two retention members which rest on the securing base, the retention members being arranged so as to be opposite each other in a transverse direction of the switch contact bridge, to the at least one retention member has at least two stops for the switch contact bridge spaced apart from each other in a longitudinal direction (L) of the switch contact bridge.

2. The switch contact subassembly according to claim 1, wherein the switch contact bridge is clamped in a secure manner in the contact bridge retention member by means of the resilient element and the switch contact subassembly may thereby be able to be handled in one piece.

3. The switch contact subassembly according to claim 1, wherein the at least one retention member can be resiliently redirected away from the switch contact bridge.

4. The switch contact subassembly according to claim 1, wherein the at least one retention member is formed so as to have two guiding faces for the switch contact bridge, which faces are directed away from each other and which extend parallel with the switching direction.

5. The switch contact subassembly according to claim 1, wherein the two retention members define at least three bearing locations (P) for the switch contact bridge.

6. The switch contact subassembly according to claim 1, wherein the two retention members each have at least one stop for the switch contact bridge.

7. The switch contact subassembly according to claim 1, wherein the switch contact bridge has at least one abutment projection which protrudes in a transverse direction (Q) and which is in abutment against at least one retention member in the rest position (R).

8. The switch contact subassembly according to claim 1, wherein the securing base is constructed so as to have a securing opening which extends in the switching direction (S).

9. The switch contact subassembly according to claim 8, wherein the switch contact bridge has an assembly through-opening through which the securing opening is accessible.

10. The switch contact subassembly according to claim 9, wherein the securing opening, the assembly opening and the resilient element delimit an assembly tunnel.

11. The switch contact subassembly according to claim 1, wherein the switch contact subassembly has an actuation member to which the securing base of the contact bridge retention member is secured.

12. The switch contact subassembly according to claim 11, wherein the actuation member is riveted to the securing base, a securing end of the actuation member forming a rivet head.

13. The switch contact subassembly according to claim 11, wherein the actuation member has a flange at a securing end, whereby a surface-area of a support shoulder for supporting the securing base is enlarged.

* * * * *